US008088020B2

(12) United States Patent
Groves

(10) Patent No.: US 8,088,020 B2
(45) Date of Patent: Jan. 3, 2012

(54) GOLF SWING TRAINING APPARATUS

(76) Inventor: Scott D. Groves, Wadsworth, OH (US)

( * ) Notice: Subject to any disclaimer, the term of this patent is extended or adjusted under 35 U.S.C. 154(b) by 0 days.

(21) Appl. No.: 12/902,342

(22) Filed: Oct. 12, 2010

(65) Prior Publication Data

US 2011/0086721 A1 Apr. 14, 2011

Related U.S. Application Data

(60) Provisional application No. 61/250,665, filed on Oct. 12, 2009.

(51) Int. Cl.
*A63B 69/36* (2006.01)

(52) U.S. Cl. ..... 473/266; 473/277

(58) Field of Classification Search ..... 473/207, 473/215, 266, 269, 272, 273, 275, 276, 277
See application file for complete search history.

(56) References Cited

U.S. PATENT DOCUMENTS

| | | | | |
|---|---|---|---|---|
| 2,252,831 | A | 8/1941 | Botts | |
| 3,138,388 | A * | 6/1964 | Herold | 473/276 |
| 3,698,721 | A | 10/1972 | Stewart | 273/186 |
| 5,303,926 | A | 4/1994 | Owens et al. | 273/186.1 |
| 6,575,844 | B1 | 6/2003 | Gray | 473/277 |
| 6,805,641 | B2 | 10/2004 | Pope | 473/274 |
| 6,843,730 | B1 | 1/2005 | Bellagamba | 473/216 |
| 7,063,626 | B2 * | 6/2006 | Cardosi | 473/257 |
| 7,275,998 | B1 | 10/2007 | Jenkins | 473/274 |
| 7,431,661 | B1 * | 10/2008 | Cailey | 473/257 |
| 7,758,443 | B1 * | 7/2010 | Ford | 473/266 |
| 2008/0234062 | A1 * | 9/2008 | Van Heerden | 473/216 |

FOREIGN PATENT DOCUMENTS

| | | |
|---|---|---|
| JP | 10-305125 | 11/1998 |

* cited by examiner

*Primary Examiner* — Nini Legesse
(74) *Attorney, Agent, or Firm* — Renner Kenner Greive Bobak Taylor & Weber

(57) ABSTRACT

A golf swing training apparatus includes a base, a supporting member extending from the base and a body restraining member slidably and pivotably coupled to the supporting member. A swivel mechanism detachably interconnects the supporting member to the body restraining member. The body restraining member includes a slide member with an enlarged cylindrical roller at one end. The swivel mechanism allows the cylindrical roller to be positioned to any height and any angular position within a substantially 360° range of motion. A pivotable supporting member may also be provided.

19 Claims, 10 Drawing Sheets

GOLF SWING TRAINING APPARATUS

CROSS-REFERENCE TO RELATED APPLICATIONS

This application claims priority of U.S. Provisional Application Ser. No. 61/250,665 filed Oct. 12, 2009 which is incorporated herein by reference.

TECHNICAL FIELD

Generally, the present invention is directed to training devices. Specifically, the present invention is directed to a golf swing training apparatus. More particularly, the present invention is directed to a golf swing training apparatus which is easily adaptable to different configurations and adjustable to variations within those particular configurations.

BACKGROUND

Training tools of many different types are widely used in the sport of golf. In particular, golf training tools or devices often focus on alignment of the head, in relation to the body, during the golf swing. Other devices focus specifically on the position of the golfer's back during a golf swing. And still other devices attempt to control the position of the golfer's legs and hips in order to properly train the golfer as to where those body parts should be positioned during a golf swing. However, these particular devices are only configured to handle one particular body part and are not adaptable to other body parts.

Some training devices constrain a number of different body parts at the same time. However, it is believed that such constraining devices may interfere with the golfer's proper motion in one particular aspect of their swing. This may result in the golfer correcting one aspect of their swing but at the same time interfering with another aspect of their swing that does not need correcting. The few devices which do allow for proper motion while correcting a particular aspect of the golfer's swing are still limited in their adaptability. In other words, these devices are integral constructions and are not easily re-configured or cannot easily be moved from place to place. Moreover, those devices that do restrain only a single particular body part are inadequately sized so as to conform to a golfer's natural motion. Therefore, there is a need in the art for a device that is easily adaptable to different configurations, is easily angularly and positionally adjusted, and portable. Additionally, there is a need for a training apparatus which is sized to a golfer's natural motion.

SUMMARY OF THE INVENTION

In light of the foregoing, it is a first aspect of the present invention to provide a golf swing training apparatus.

It is another aspect of the present invention to provide a golf swing training apparatus comprising a base, a supporting member extending from the base, and a body restraining member slidably and pivotably coupled to the supporting member.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
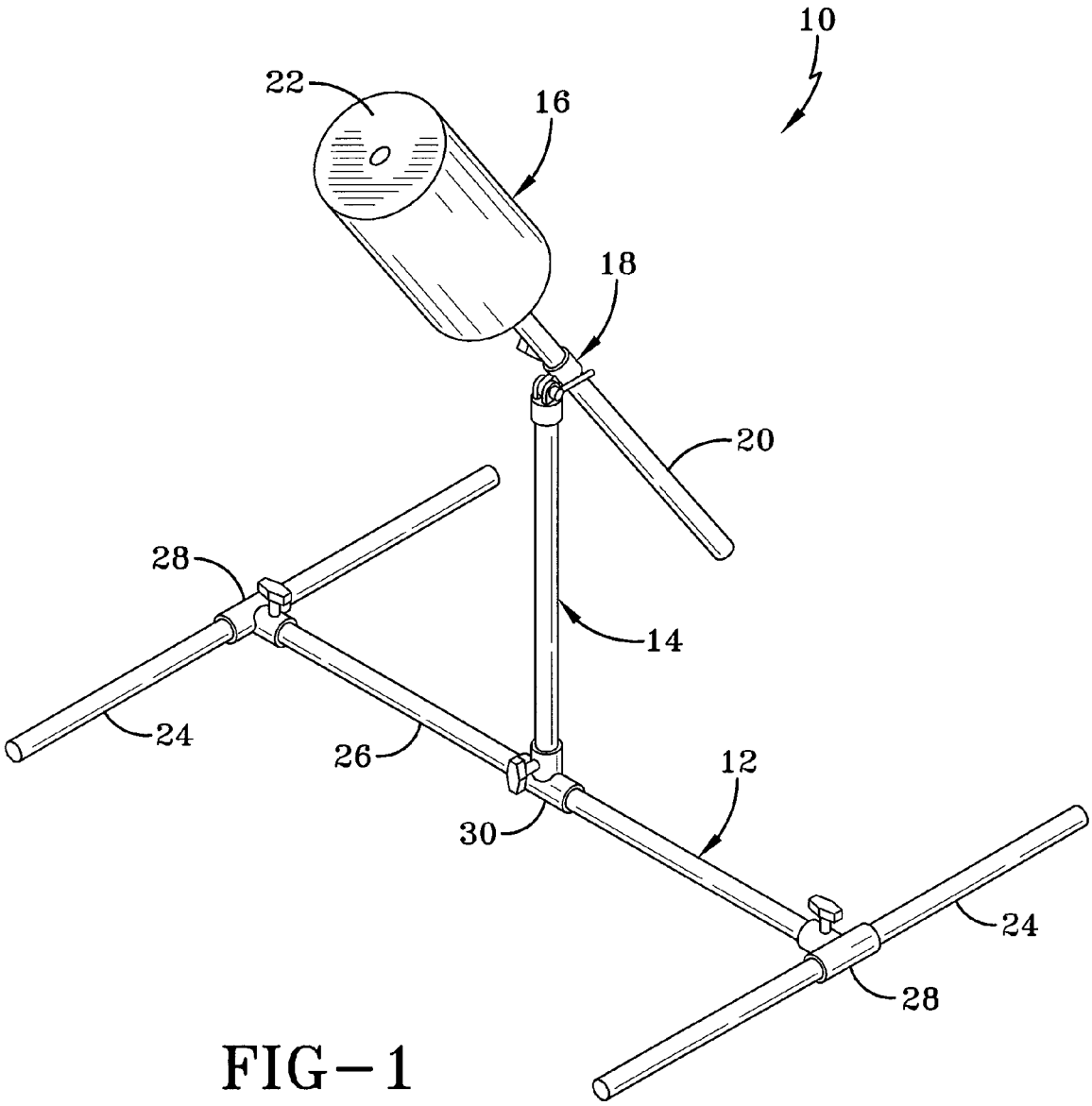
FIG. 1 is a perspective view of a golf swing training apparatus made in accordance with the concepts of the present invention.

Referring now to the drawings and particularly to FIG. 1, it can be seen that a golf swing training apparatus is designated generally by the numeral 10. The apparatus 10 includes a base 12 from which vertically extends a support member 14. Coupled to the support member 14 is a body restraining member 16. A swivel mechanism 18 is utilized to detachably couple and interconnect the support member 14 to the body restraining member 16. As will become apparent as the detailed description proceeds, the swivel mechanism 18 is utilized to move the body restraining member 16 to any number of angular adjustable and height adjustable positions. In other words, the body restraining member can be positioned at virtually any angle and height based upon adjustment of the swivel mechanism 18.

The body restraining member 16 includes a slide tube 20 which may also be of a solid construction. The slide tube 20 may be constructed of any material, although it is believed that aluminum would provide the benefits of light weight and strength. In most embodiments, the tube has a circular cross-section but the cross-section could be of any shape. Secured to one end of the slide tube 20 is a cylindrical roller 22. The roller is constructed of a foam material such as polyethylene or other polymeric material and is of such size so as to provide benefits in the positioning of limbs or body parts of a golfer so as to maintain proper natural motion of a golfer's swing. The roller 22 is constructed of a light weight material with resilient properties so as to be comfortable adjacent the golfer's body while providing enough force so as to provide a clear indication to the golfer as to proper posture and positioning during their swing. If desired, different sizes and/or shapes of rollers may be secured to the member 20.

The base 12 includes a pair of opposed legs 24 connected to one another by a center member 26. The base 12 forms an H-shape so as to provide stability to the training apparatus. Although tubular constructions can be used for the legs 24 and the center member 26, it is believed that solid constructions of substantial weight may be utilized to provide stability to the base and thus the apparatus 10. The center member 26 is connected to each leg 24 by a leg T-fitting 28. Utilization of the T-fittings is advantageous in that the apparatus may be easily dis-assembled and re-assembled as needed. A support T-fitting 30 is maintained centrally about the center member 26 and, as such, the T-fitting receives one end of the vertically extending support member 14. The T-fitting 30 may allow for the support member 14 to be positioned anywhere along the length of the center member 26. Skilled artisans will appreciate that the T-fittings 28, 30 are provided with a threaded handle that extends through a side wall of the fitting and holds the center member 26 in place.

Figure 2:
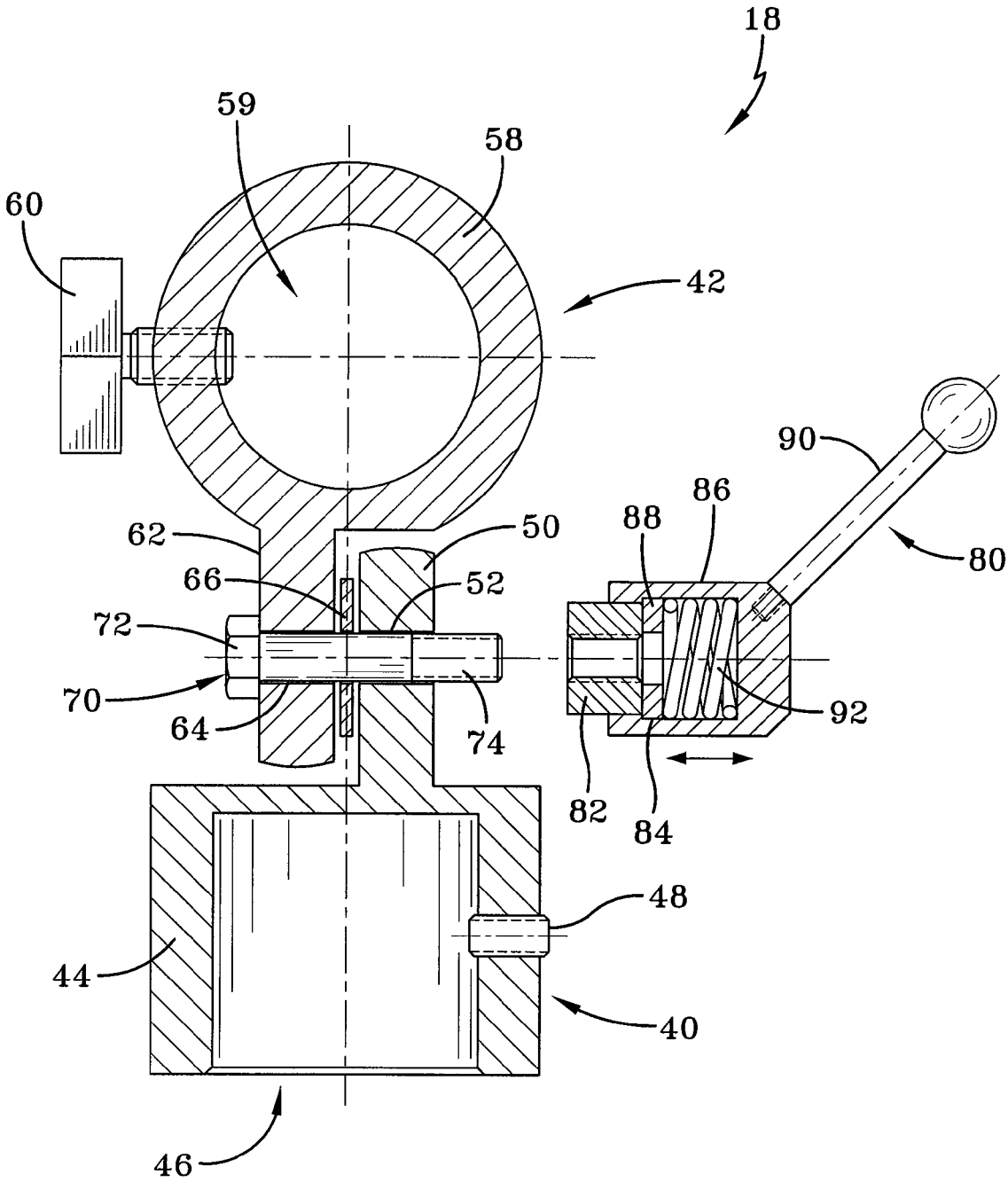
FIG. 2 is a cross-sectional elevational view of the apparatus's swivel mechanism which allows for adjustment of a position restraining member.
Figure 3:
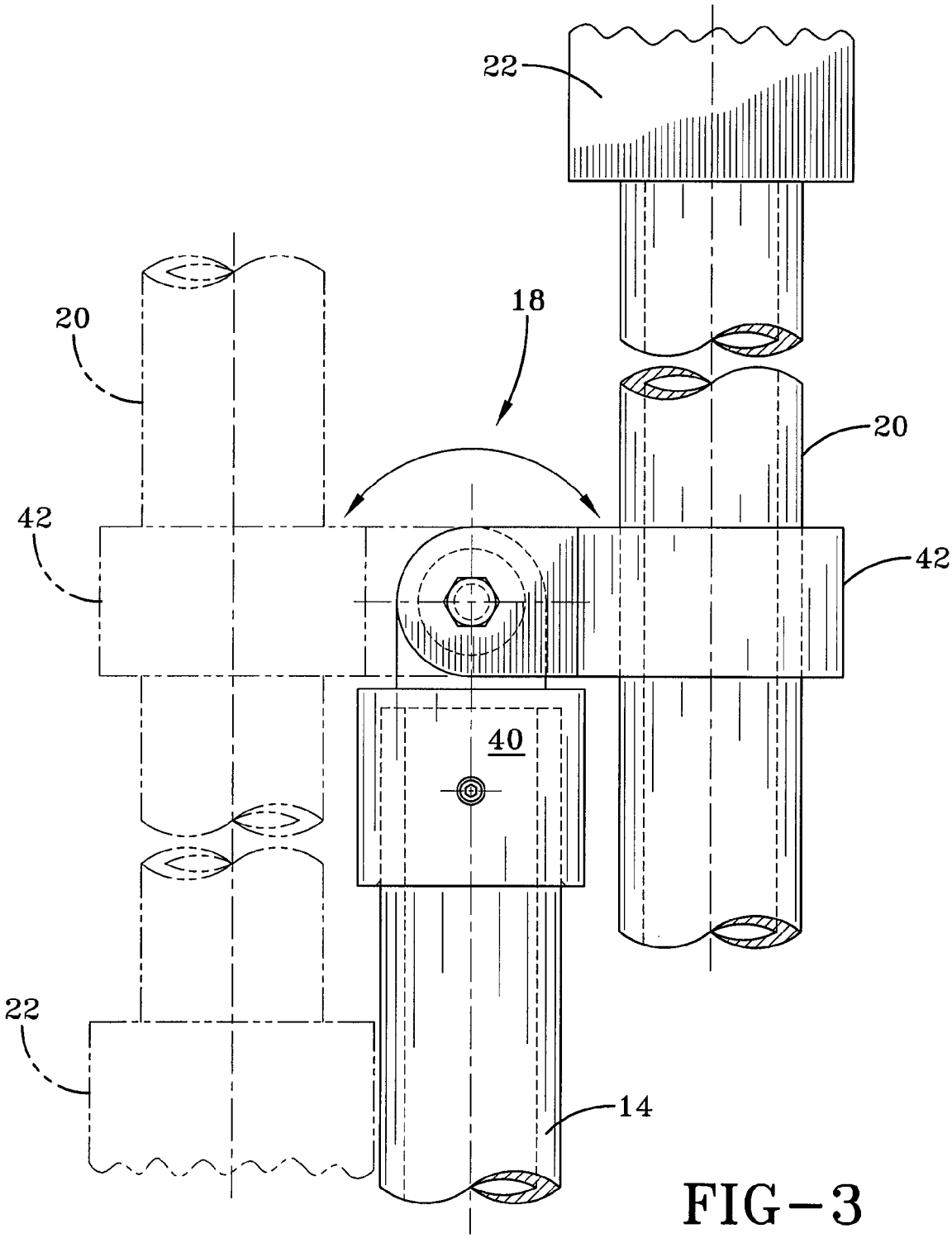
FIG. 3 is a side elevational view of the swivel mechanism, partially in phantom, showing the swivel mechanism's range of motion.

Referring now to FIGS. 2 and 3, it can be seen that the swivel mechanism 18 is attached to a distal end of the support member 14. In other words, the swivel mechanism is connected to the end of the support member 14 opposite the end of the support member connected to the center member 26. The swivel mechanism includes a cap 40 that carries a collar 42 that is pivotably movable with respect to the cap.

The cap 40 includes a cap wall 44 which has an opening 46 at one end so as to receive the corresponding end of the vertical support member 14. A set screw 48 extends through the cap wall 44 so as to hold the cap 40 securely to the end of the support member. Loosening of the set screw allows the swivel mechanism to be rotated 360° so as to allow a further positioning of the roller 22. Extending from a closed end of the cap wall 44 is a cap flange 50 that has a flange hole 52 extending therethrough.

The collar 42 includes a ring wall 58 which has a ring hole 59 extending therethrough which slidably receives the slide member 20. A T-adjustment handle 60 has a threaded end that extends through a threaded hole in the ring wall 58 so as to detachably hold the slide member 20 in an adjustable position where needed. In other words, the cylindrical roller, which is attached to the slide member, may be positioned immediately adjacent the ring wall 58, or the slide member be fully extended so that the cylindrical roller is maintained as far as possible from the swivel mechanism 18. Extending from the ring wall 58 is a collar flange 62 which has a collar flange hole 64 extending therethrough. A lock washer 66 is interposed between the collar flange 62 and the cap flange 50 and is utilized to maintain the angular position of the collar 42 with respect to the cap 40 as will be described in further detail.

A fixed bolt 70 is secured to the collar flange 62 and extends through the flange hole 64 and through the flange hole 52. Skilled artisans will appreciate that the bolt 70 also extends through the lock washer 66. The bolt 70 includes a head 72 that is fixed to the outward facing surface of the collar flange. Specifically, the bolt 70 is fixed to the collar flange 62 but not to the cap flange 50. Opposite the head 72 is a threaded end 74 which extends through the flange holes and is exposed for a minimal distance so as to allow securement of a lever handle designated generally by the numeral 80 thereto. Rotation of the handle 80 is used to pull or secure the collar 42 to the cap 40. Specifically, the collar flange 62 is brought into bearing contact with the cap flange 50 and with the lock washers therebetween, the angular position of the collar with respect to the cap is secured.

The lever handle 80 includes a bushing 82 which is internally threaded so as to receive the threaded end 74 of the bolt 70. The bushing includes ratchet teeth 84 which are received within a socket 86 of the lever handle. The socket 86 also provides ratchet sockets 88 which mesh and engage with the ratchet teeth 84. An arm 90 extends from an exterior of the socket 86 so as to provide a useful grip for the user to adjust the angular position of the swivel mechanism 18. A spring 92 is internally maintained within the lever handle and is disposed between an end of the bushing 82 and an internal surface of the socket 86. By pulling on the handle against the biasing force of the spring, the user can adjust the positioning of the arm 90 into a convenient position. Once the sockets 88 and teeth 84 are re-engaged, the handle is positioned to provide the appropriate leverage.

Figure 5:
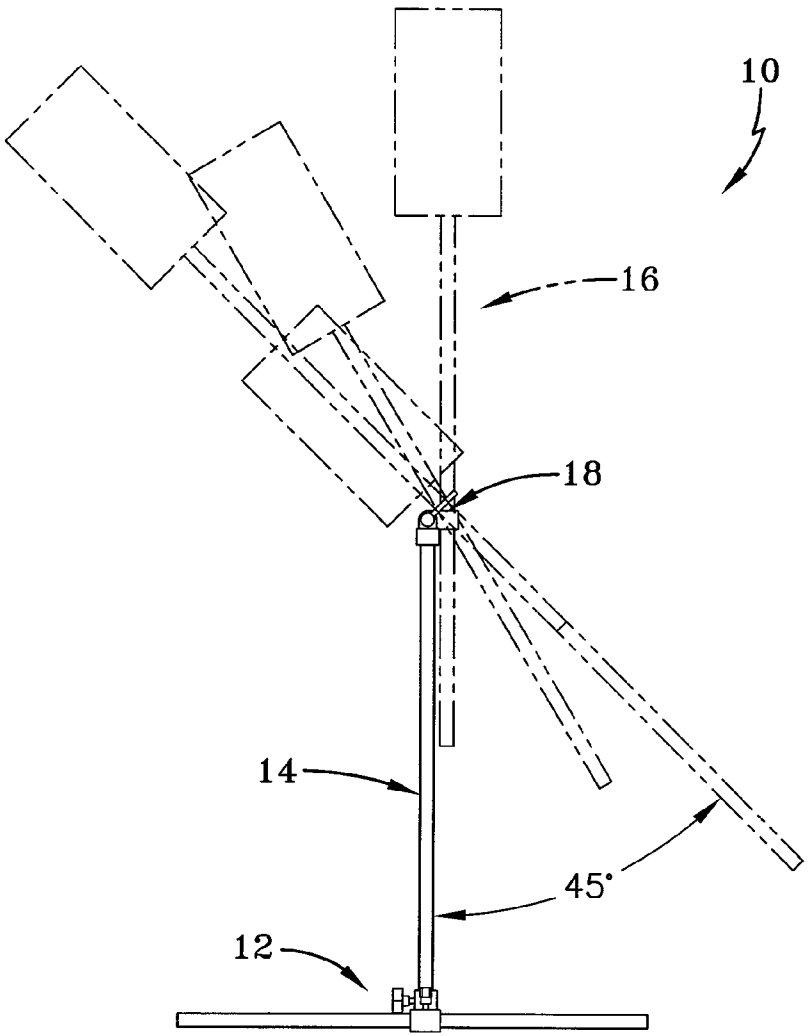
FIG. 5 is a left side elevational view of the training apparatus with different angular positions of the position restraining member shown in various different angular positions and heights.
Figure 4:
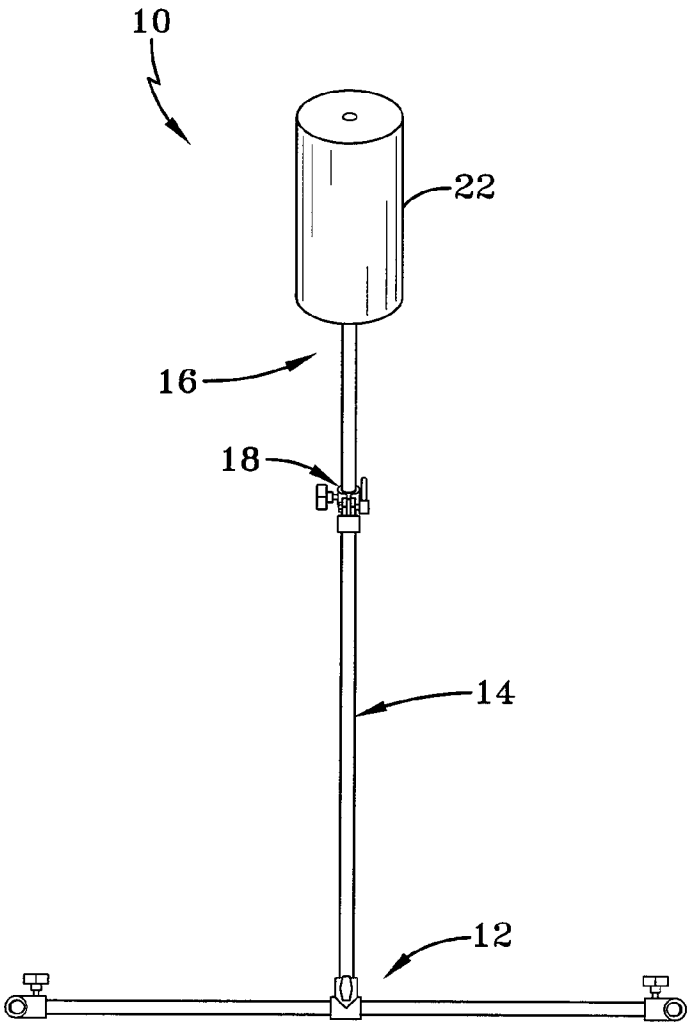
FIG. 4 is a front side elevational view of the training apparatus according to the present invention.

FIG. 3 shows the swivel mechanism without the lever handle 80 or the handle 60 so as to allow viewing of the angular positions obtainable. Specifically, it is noted that the collar 42 has an angular motion of travel of about 180°. In other words, the slide member 20 retained within the collar 42 can be moved from a position facing vertically up to a position such that the cylindrical roller is facing vertically down. Moreover, since the collar 42 allows for positional adjustment of the slide member 20, it will be appreciated that by changing the entry point of the slide member 20 into the collar 42, the cylindrical roller can be positioned virtually anywhere within a substantially 360° range of motion. Examples of the various ranges of motion are shown in FIGS. 4 and 5, wherein exemplary adjustable height and adjustable angular positions are shown in phantom. Indeed, skilled artisans will appreciate that the swivel mechanism 18 allows for three different positional adjustments. Loosening and tightening of the set screw 48 permits 360° rotation of the mechanism. Loosening and tightening of the handle 80 permits −90° to +90° adjustment with the slide member inserted one way into the collar 42 and +90° to +270° adjustment with the slide member inserted an opposite way into the collar 41. Finally, loosening and tightening of the handle 60 permits a length adjustment of the roller 22 with respect to the swivel mechanism.

Figure 6:
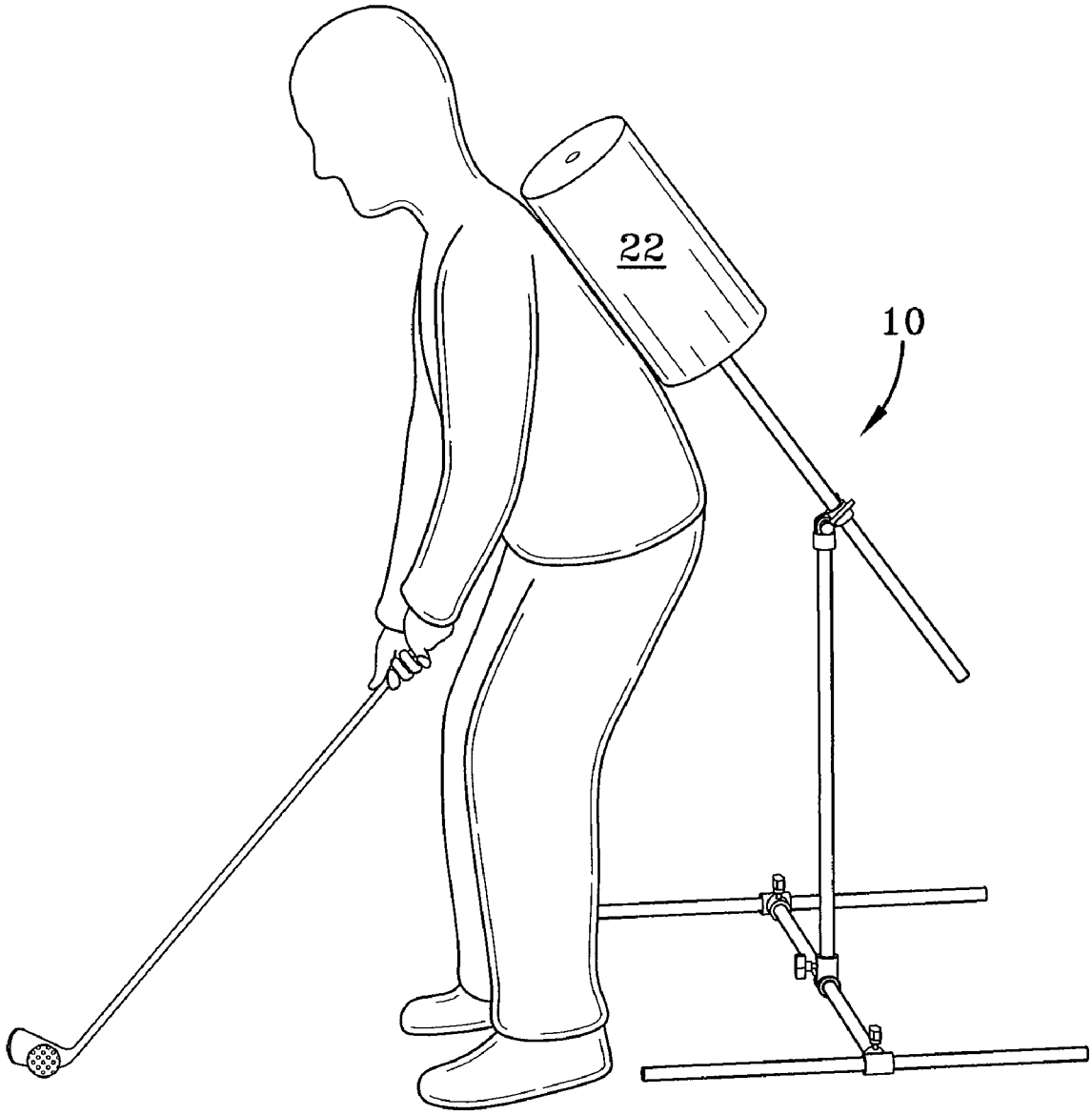
FIG. 6 is a perspective view of the training apparatus in use with the body restraining member placed adjacent a golfer's back.
Figure 7:
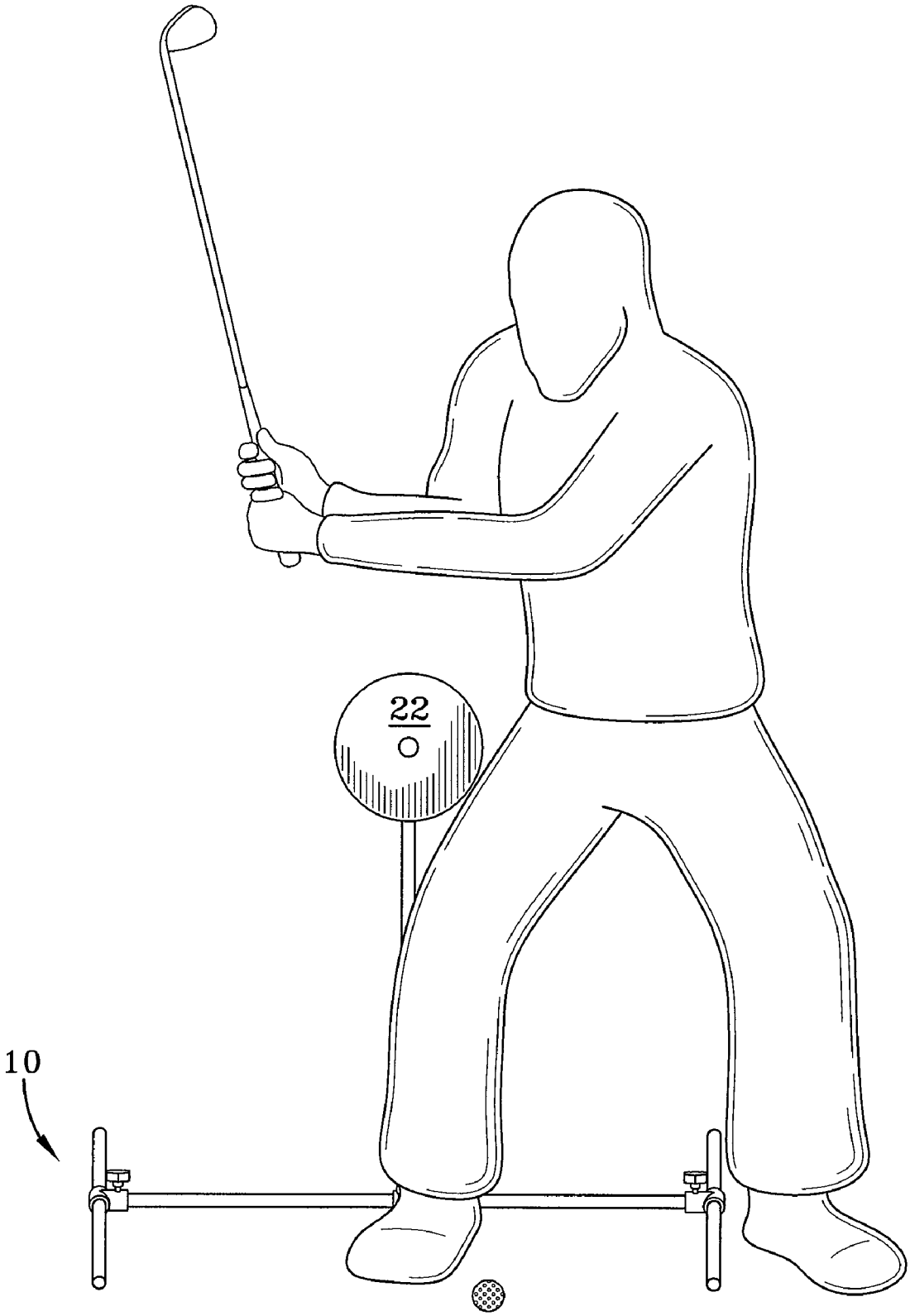
FIG. 7 is a perspective view of the training apparatus in use with the body restraining member placed adjacent a golfer's hip.
Figure 8:
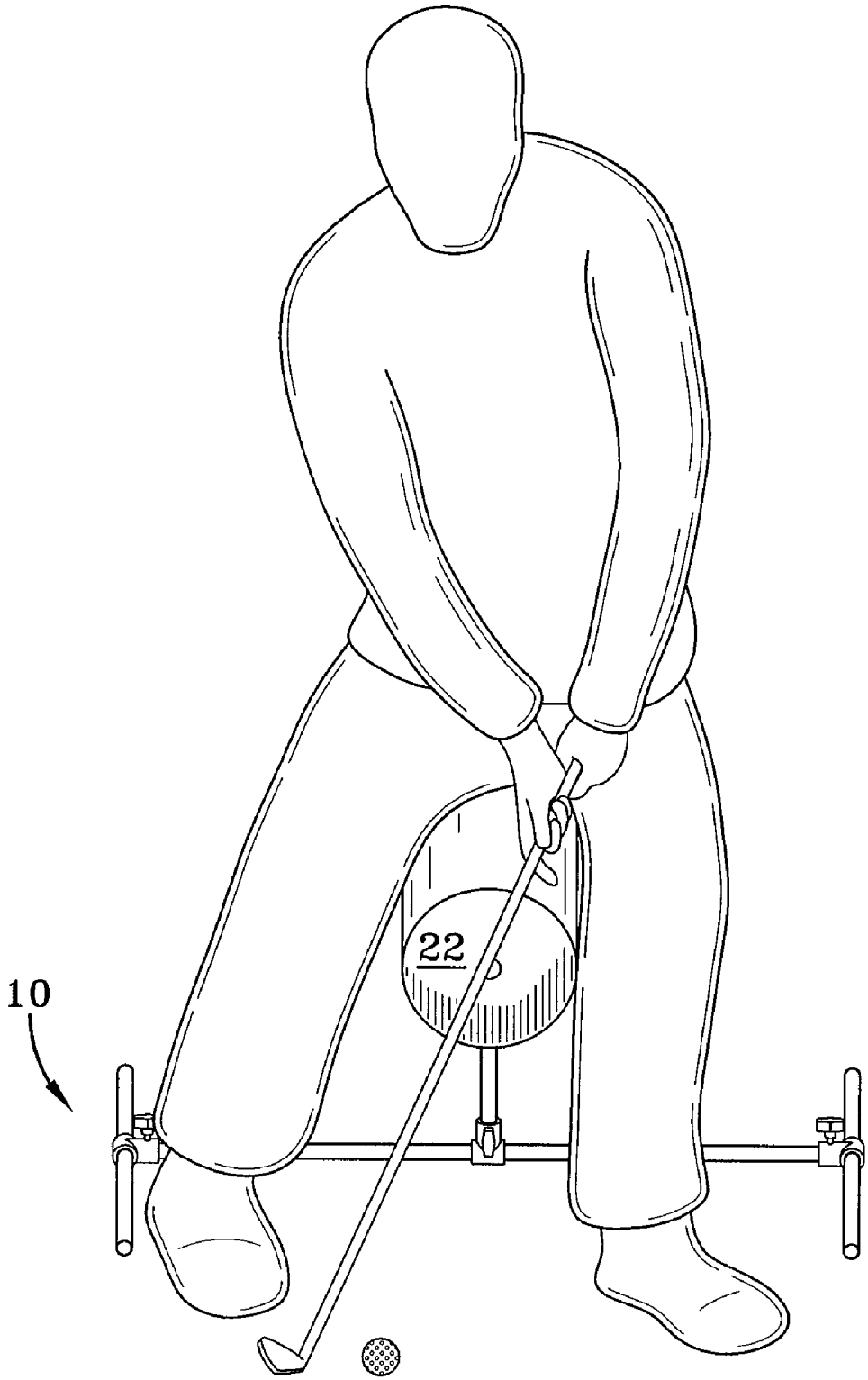
FIG. 8 is a perspective view of the training apparatus in use with the body restraining member placed between a golfer's knees.

Referring to FIGS. 6, 7 and 8, it can be seen that the apparatus can be used in various different configurations so as to maintain proper form of a golfer's swing. FIG. 6 shows the cylindrical roller positioned adjacent a golfer's back. Skilled artisans will appreciate that the enlarged diameter of the roller 22, which in some embodiments is larger than 6 inches, can in other embodiments be as large as 48 inches. The cylindrical roller is secured to the end of the slidable member wherein the cylindrical roller is sized to maintain contact with a substantial width of a golfer's back while he or she is swinging a golf club. FIG. 7 shows the cylindrical roller placed adjacent a golfer's hip so as to prevent undesirable swaying motion during the golf swing. FIG. 8 shows the cylindrical roller placed between the golfer's knees so as to ensure a proper stance and motion during chipping and putting and so as to provide feedback to the golfer for stabilizing or maintaining a fluid motion during their golf swing.

The advantages of the present invention are readily apparent to those skilled in the art. Specifically, it will be appreciated that the swivel mechanism 18 allows for slidable and pivotable adjustment of the cylindrical roller such that it can be positioned near or adjacent any part of the golfer's body. As shown in the Figures, the cylindrical roller can be placed adjacent the golfer's back, hips and knees, but it will be appreciated that the cylindrical roller could be used to properly position a golfer's head, torso, arms, or virtually any other body part that needs corrective manipulation during a golf stance or swing. The swivel mechanism allows for height adjustment of the roller and specifically, by utilization of the T-adjustment handle 60 the slide member can be extended such that the roller 22 is positioned adjacent the swivel mechanism or fully extended as far as the length of the tube 20 is practical. The spring-biased lever handle 80 allows for pivotable adjustment of the swivel mechanism, and specifically pivotable adjustment of the collar 42 with respect to the cap 40. This allows for adaptations to golfers of different heights and sizes and to particular postures that each individual golfer may have. Finally, the present invention is advantageous in that it is easily assembled and dis-assembled for storage and easy portability.

Figure 9:
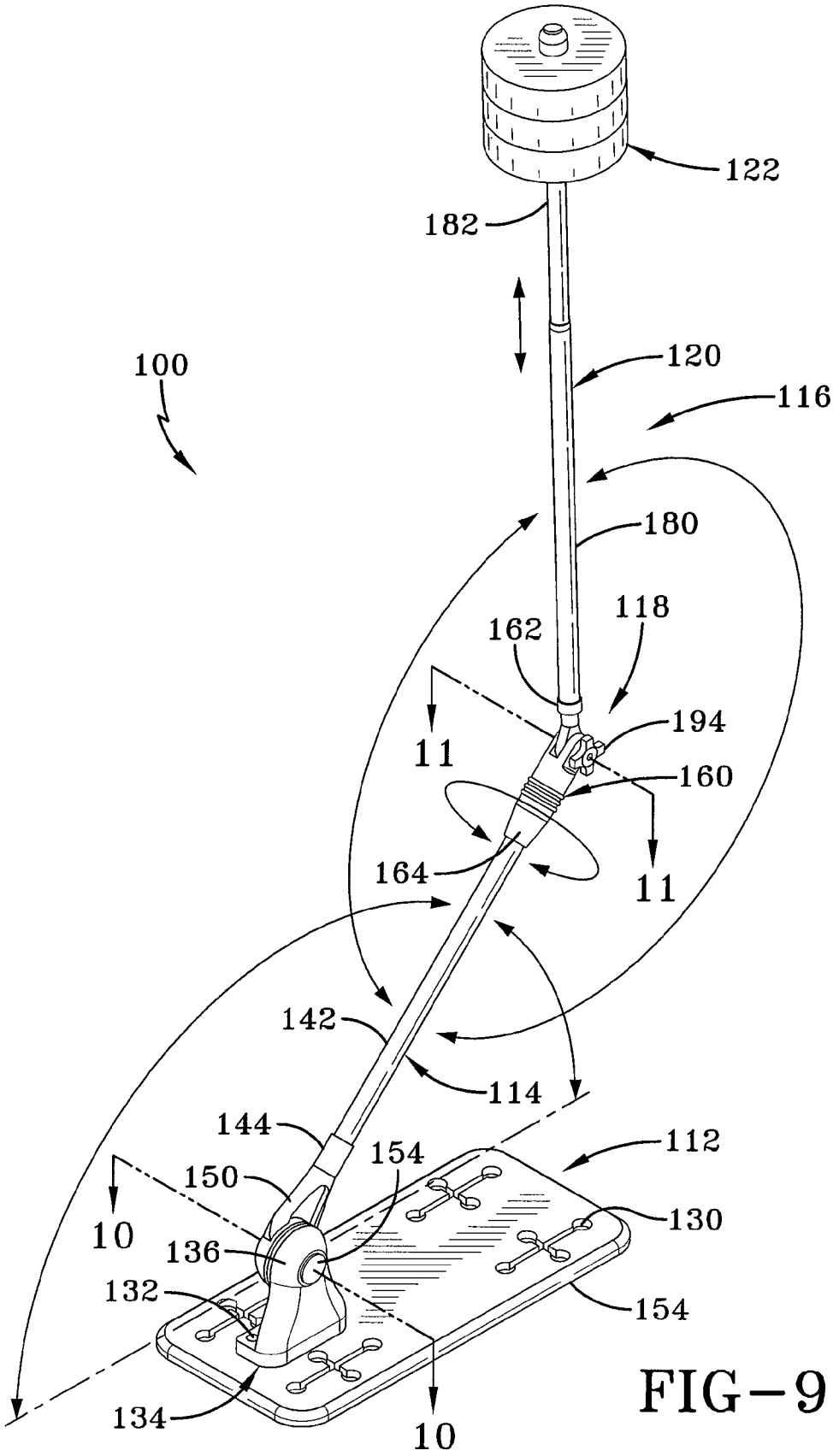
FIG. 9 is a perspective view of an alternative embodiment of a golf swing training apparatus made in accordance with the concepts of the present invention.
Figure 10:
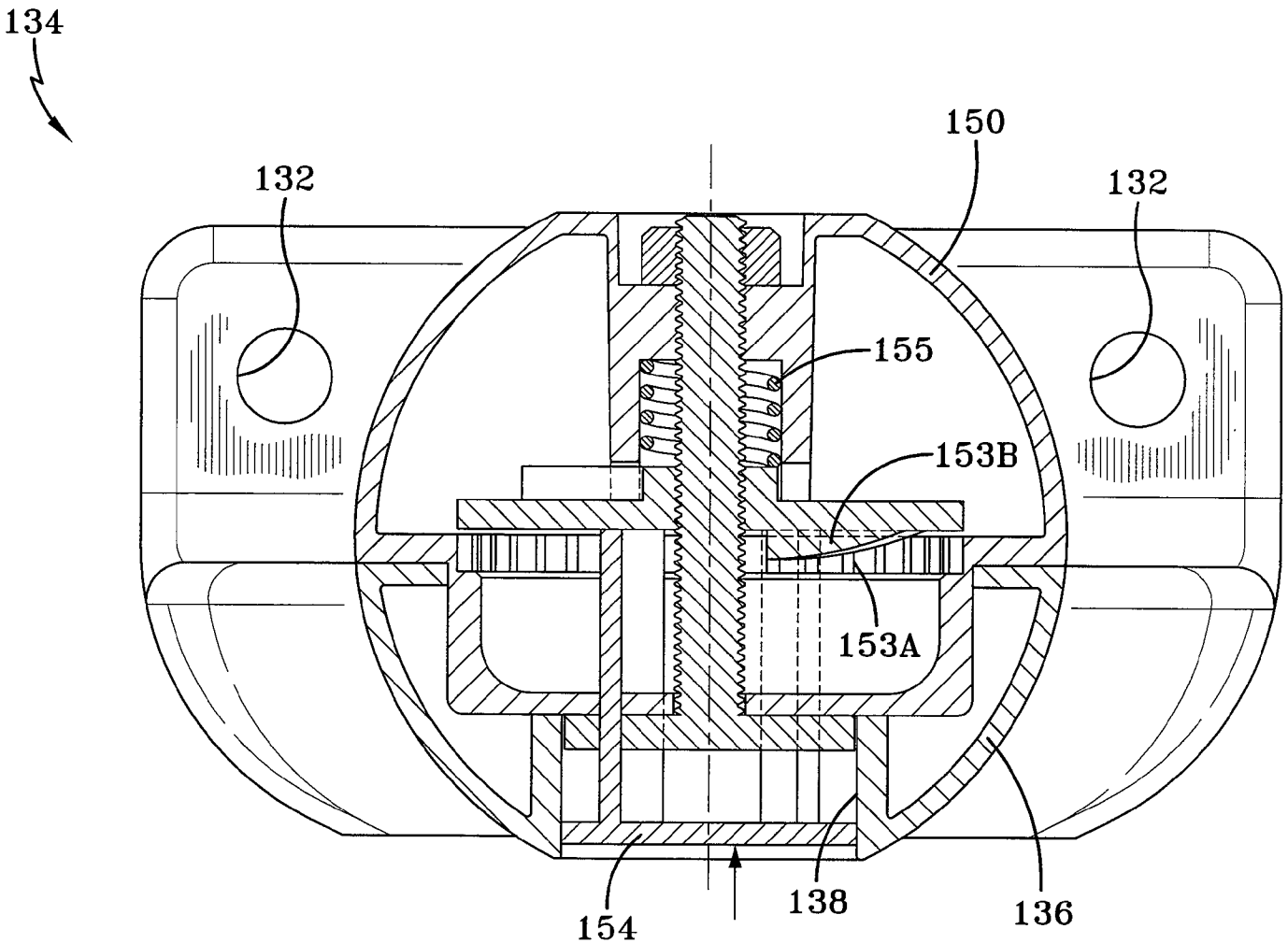
FIG. 10 is a cross-sectional view taken along line 10-10 of FIG. 9 of a bracket that allows selective pivotable movement of a supporting member with respect to a base of the alternative training apparatus.
Figure 11:
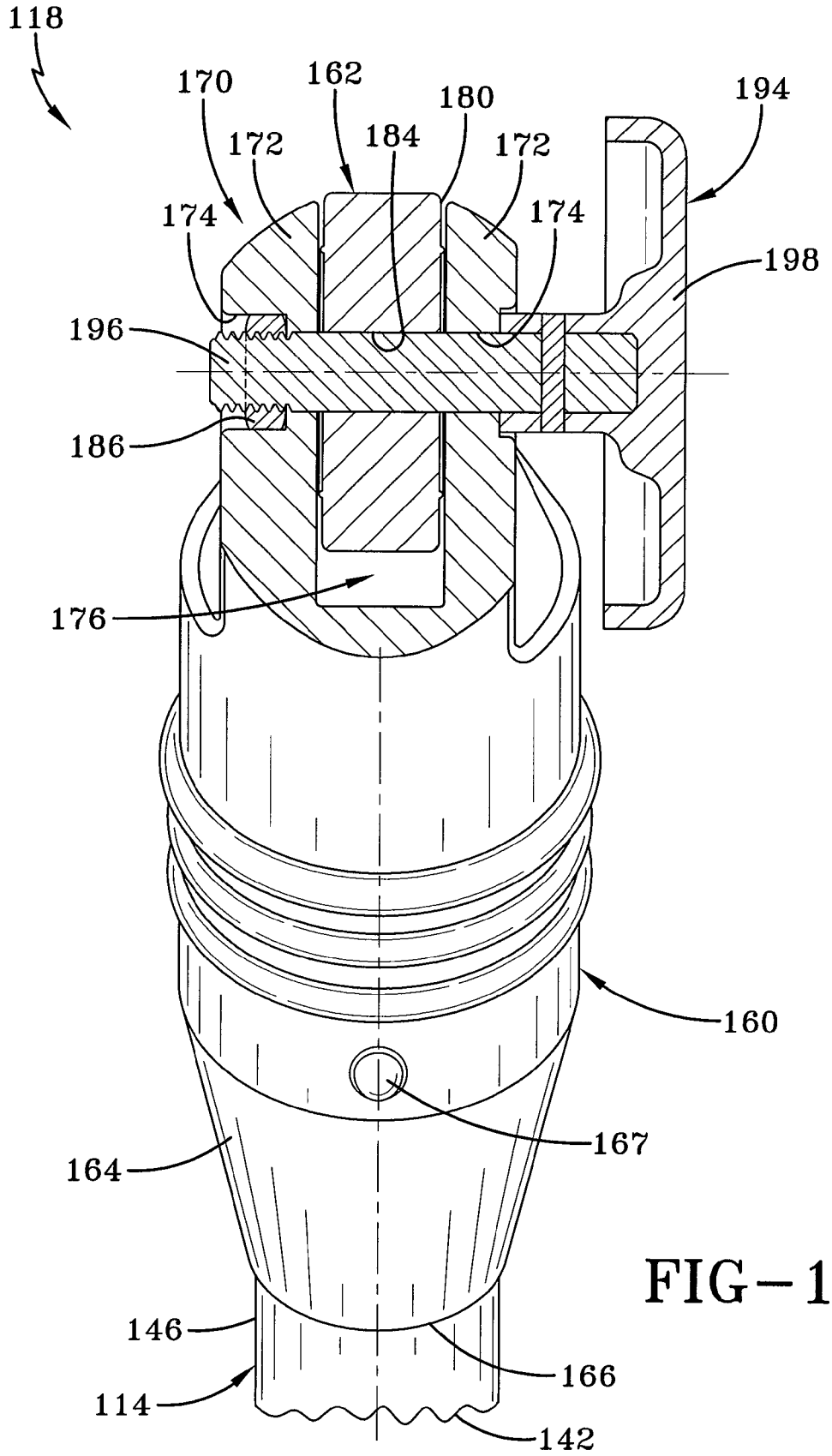
FIG. 11 is a cross-sectional elevational view taken along line 11-11 of FIG. 9 of a swivel mechanism which allows for angular adjustment of a position restraining member of the alternative training apparatus.

Referring now to FIGS. 9-11, it can be seen that an alternative golf swing training apparatus is designated generally by the numeral 100. The apparatus 100 is similar to the apparatus 10 but is provided with refinements in regard to the ability of the support member to pivot with respect to the base. The structural features and operational benefits of this feature will become apparent as the description proceeds. The apparatus 100 includes a base 112 from which pivotably extends a support member 114. As will become apparent as the description proceeds, the support member 114 has an approximate range of motion of 0 to 180° with respect to the base. Extending from the pivotable support member 114 is a body restraining member 116 wherein the members 114 and 116 are interconnected to one another by a swivel mechanism designated generally by the numeral 118. The body restraining member 116 includes a rod 120, wherein one end is coupled to the swivel mechanism 118 and an opposite end carries a roller 122.

The base 112 includes a plurality of holes 130 with various inset features which receive golf tees or spikes to stake the base 112 into the ground. In other words, the apparatus 100 can be positioned on a level golfing surface such as a practice tee or driving range using golf tees or spikes that are appropriately sized. This allows for easy installation and removal after use of the training device is complete. The base 112 also includes a plurality of attachment holes 132.

A bracket 134 is attached to the base 112 via the attachment holes 132 and appropriate fasteners. The bracket 134 includes an adjustment collar interlock 136 which has a collar hole 138 extending therethrough.

The pivotable support member 114 includes a support rod 142 which may be a solid rod configuration or a tubular member made out of an appropriate material such as aluminum or heavy-duty plastic. The support rod 142 includes a bracket end 144 opposite an elbow end 146. Secured to the bracket end 144 is a bracket collar interlock 150 which has a collar hole 152 extending therethrough. An adjustment pin 154 is receivable through the collar hole 152 and the collar hole 138 so as to allow for securement of the adjustment collar interlock 136 adjacent the bracket collar interlock 150.

As best seen in FIG. 10, the interlocks 136 and 150 may be configured with corresponding mating teeth 153*a*, 153*b* so as to allow for positional adjustment of the support member 114 with respect to the base 112. The adjustment pin 154 may be biased with a spring 155 such that movement of the pin allows for release of the interlocking mechanism between the collars 136 and 150 so as to allow for their pivotable adjustment and wherein release of the force on the spring biased pin 154 allows for the interlocking features to re-engage one another so as to angularly set the support member 114 in a position where desired. As can be seen in FIG. 9, the support member 114 has approximately a 0 to 180° range of motion with respect to the base. Of course, the interlocks 136, 150, the mating teeth 153*a*, 153*b*, and the adjustment pin 154 may be configured in different ways to allow for angular adjustment of the member 114 with respect to the base. For example, the pin 154 may be in the form of a threaded bolt with a handle that secures the interlocks to one another in a desired angular position. Or the mating teeth could be configured as coacting cam surfaces.

The swivel mechanism 118, as best seen in FIGS. 9 and 11, couples the body restraining member 116 to the pivotable support member 114. The swivel mechanism includes a base member end 160 and a restraining member end 162. The base member end 160 includes a cap 164 which has a base member socket 166 that receives the elbow end 146 of the support rod 142. The end 146 may be detachably received and secured in the socket 166 by a detent ball feature. The end may also be secured by a set screw or other similar fastening configuration. In another feature, the cap 164 may be rotatable about the elbow end 146 and set in a desired orientation, wherein the end 146 and the socket 166 are multi-sided such as in a hex configuration. The angular increments may be set for particular increments, such as 15° or 45°, or in some embodiments the angular orientation can be any angular orientation wherein the angular position of cap 164 is fixed by a set screw 167.

The cap 164 also includes a clevis 170 which provides opposed flanges 172, each of which has a flange hole 174 extending therethrough. The flanges 172 form a gap 176 which is used to receive the body restraining member 116 as will be described.

The body restraining member 116 includes the rod 120 which provides an elbow end 180 opposite a roller end 182. The elbow end 180 has an elbow hole 184 extending crosswise therethrough. The elbow end 180 is received in the gap 176 and the hole 184 is aligned with the flange holes 174 so as to receive a lock handle 194. It will be appreciated that a lock washer 186 may be interposed between the elbow end 180 and the flanges 172 so as to allow for angular adjustment of the body restraining member 116 with respect to the support member 114. In particular, a lock handle 194 which has a lock bolt 196 and a knob 198 extending therefrom is configured such that the bolt 196 is received through the flange holes 174 and the elbow hole 184 so as to compress the flanges 172 onto the elbow end 180. Accordingly, rotation of the knob 198 allows for a release of compression forces upon the flanges 178 so as to allow for angular adjustment of the rod 120. Tightening of the knob 198 compresses the flanges and sets the angular position of the restraining member 116. Accordingly, the body restraining member 116 is allowed to pivot or swivel in almost a 360° range of motion. In other words, if the body restraining member is placed adjacent the support member 114 with the roller end 182 facing downwardly, loosening of the lock handle 194 allows for that almost −90° position to be moved through a full range of motion to a 270° position. Of course, positioning of the support member 114 allows for further refinement to the positioning of the roller as needed.

The rod 120 may comprise an outer tube 200 that slidably receives an inner tube 202. The inner tube 202 may be fully received within the outer tube or fully extended so as to provide a varying length position for the tube or rod 120. Pin detents may be provided and corresponding detent holes may be provided in the inner tube and/or outer tube 200 so as to allow for positional adjustment of the tubes with respect to one another. In the embodiment shown, the length of the body restraining member 116, and specifically the rod 120, may be adjusted anywhere from about 26 inches to about 48 inches. Secured to the roller end 182 is the roller 122 which is as described in the previous embodiment. In other words, the roller 122 is constructed of light weight material with resilient properties so as to be comfortable adjacent the golfer's body while providing enough force so as to provide a clear indication to the golfer as to the proper posture and positioning during their swing. It will further be appreciated that the roller may be positionally adjusted with respect to the tube by use of a locking collar 210. This feature allows for the roller to be further positioned with respect to the rod 120. In some embodiments, the roller 122 may be configured from an inflatable balloon-like member.

It will be appreciated that the swivel mechanism 118 and the body restraining member 116 provide three different positional adjustments. Loosening and tightening of the set screw that secures the cap 164 permits 360° orientation of the mechanism 118. Loosening and tightening of the know 198 permits about −90° to +270° angular adjustment of the body restraining member 116. Finally, positioning of the outer tube 200 with respect to the inner tube 202 permits a length adjustment of the roller 122 with respect to the swivel mechanism 118. A fourth adjustment is also provided by the device 100 and specifically the bracket 134 which allows for a 0° to 180° range of motion for the support member 114 with respect to the base 112.

To facilitate assembly and disassembly of the apparatus, both rods 142 and 120 may be provided at each respective end 144, 146 and 180, 182 with a detent ball that is received in a corresponding receptacle provided by the bracket end 144, the swivel mechanism 118 and/or the roller 122.

The advantages of the device 100 are the same as those of the device 10 as described above. The device 100 has a further advantage of being able to provide the support member with about a 180° range of motion. This allows for further positioning of the roller 122 to assist in restraining a golfer's body during their swing.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A golf swing training apparatus, comprising:
- a base;
- a supporting member extending from said base;
- a body restraining member slidably and pivotably coupled to said supporting member, wherein said body restraining member comprises:
  - a swivel mechanism secured to said supporting member, wherein said swivel mechanism comprises:
    - a cap mountable on said supporting member, said cap having a cap flange with a cap flange hole therethrough;
    - a collar having a collar flange with a collar flange therethrough, said collar slidably retaining said slidable member; and
    - a bolt extending through said flange holes so as to allow said collar to pivot with respect to said cap; and
    - a slidable member slidably retained by said swivel mechanism;
- a cylindrical roller secured to an end of said slidable member wherein said cylindrical roller is sized to maintain a minimum of contact to a selected substantial portion of a golfer's body while swinging a golf club; and
- a lever handle received on said bolt so as to detachably secure said collar flange to said cap flange in an angular position.

2. The training apparatus according to claim 1, wherein said body restraining member comprises:
- a cylindrical roller at least six inches in diameter.

3. The training apparatus according to claim 1, wherein said body restraining member comprises:
- a cylindrical roller sized to maintain a minimum of contact to a substantial width of a golfer's back while swinging a golf club.

4. The training apparatus according to claim 1, further comprising:
- a lock washer interposed between said cap flange and said collar flange.

5. The training apparatus according to claim 4, wherein said lever handle comprises:
- a bushing received in a socket, said bushing and said socket having mating teeth that mesh with each other; and
- a spring interposed between said bushing and said socket.

6. The training apparatus according to claim 1, further comprising:
- a bracket attached to said base, said bracket having an adjustment collar interlock; and
- a bracket collar interlock secured to one end of said supporting member, said adjustment collar interlock and said bracket collar interlock coacting with each other to allow for said supporting member to have about a 180° range of motion with respect to said base.

7. The training apparatus according to claim 6, wherein said swivel mechanism comprises:
- a cap mountable on an end of said supporting member opposite said bracket collar interlock, said cap rotatably positionable about said supporting member in a 360° range of motion;
- a clevis extending from said cap, said clevis having opposed flanges coupled to an end of said body restraining member and pivotable anywhere in a substantially 360° range of motion.

8. The training apparatus according to claim 7, wherein said slidable member comprises:
- an outer tube coupled to said swivel mechanism; and
- an inner tube slidably received in said outer tube and positionally adjustable with respect to said outer tube.

9. The training apparatus according to claim 8, wherein said slidable member has an elbow end with an elbow hole extending therethrough, said flanges having flange holes that align with said elbow hole, said flange holes and said elbow hole receiving a lock handle therethrough, wherein tightening of said lock handle secures said slidable member into position and loosening of said lock handle allows for angular adjustment of said body restraining member with respect to said supporting member.

10. The training apparatus according to claim 1, wherein said swivel mechanism allows said body restraining member to pivot in almost a substantially 360° range of motion and said swivel mechanism is rotatable about said supporting member in a 360° range of motion.

11. A golf swing training apparatus, comprising:
- a base;
- a supporting member extending from said base;
- a body restraining member slidably and pivotably coupled to said supporting member, wherein said body restraining member comprises:
  - a swivel mechanism secured to said supporting member; and
  - a slidable member slidably retained by said swivel mechanism;
- a cylindrical roller secured to an end of said slidable member wherein said cylindrical roller is sized to maintain a minimum of contact to a selected substantial portion of a golfer's body while swinging a golf club;

a bracket attached to said base, said bracket having an adjustment collar interlock; and a bracket collar interlock secured to one end of said supporting member, said adjustment collar interlock and said bracket collar interlock coacting with each other to allow for said supporting member to have about a 180° range of motion with respect to said base.

12. The training apparatus according to claim 11, wherein said swivel mechanism comprises:

a cap mountable on said supporting member, said cap having a cap flange with a cap flange hole therethrough;

a collar having a collar flange with a collar flange therethrough, said collar slidably retaining said slidable member; and a bolt extending through said flange holes so as to allow said collar to pivot with respect to said cap.

13. The training apparatus according to claim 12, further comprising:

a lever handle received on said bolt so as to detachably secure said collar flange to said cap flange in an angular position.

14. The training apparatus according to claim 13, further comprising:

a lock washer interposed between said cap flange and said collar flange.

15. The training apparatus according to claim 14, wherein said lever handle comprises:

a bushing received in a socket, said bushing and said socket having mating teeth that mesh with each other; and a spring interposed between said bushing and said socket.

16. The training apparatus according to claim 11, wherein said swivel mechanism comprises:

a cap mountable on an end of said supporting member opposite said bracket collar interlock, said cap rotatably positionable about said supporting member in a 360° range of motion;

a clevis extending from said cap, said clevis having opposed flanges coupled to an end of said body restraining member and pivotable anywhere in a substantially 360° range of motion.

17. The training apparatus according to claim 16, wherein said slidable member comprises:

an outer tube coupled to said swivel mechanism; and an inner tube slidably received in said outer tube and positionally adjustable with respect to said outer tube.

18. The training apparatus according to claim 17, wherein said slidable member has an elbow end with an elbow hole extending therethrough, said flanges having flange holes that align with said elbow hole, said flange holes and said elbow hole receiving a lock handle therethrough, wherein tightening of said lock handle secures said slidable member into position and loosening of said lock handle allows for angular adjustment of said body restraining member with respect to said supporting member.

19. The training apparatus according to claim 11, wherein said swivel mechanism allows said body restraining member to pivot in almost a substantially 360° range of motion and said swivel mechanism is rotatable about said supporting member in a 360° range of motion.

* * * * *